US009256188B2

(12) United States Patent
Kasamatsu et al.

(10) Patent No.: US 9,256,188 B2
(45) Date of Patent: Feb. 9, 2016

(54) IMAGE FORMING APPARATUS

(71) Applicant: Konica Minolta, Inc., Chiyoda-ku, Tokyo (JP)

(72) Inventors: Toru Kasamatsu, Toyokawa (JP); Mikiyuki Aoki, Toyohashi (JP); Yohei Yamada, Hino (JP); Kouei Cho, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/662,865

(22) Filed: Mar. 19, 2015

(65) Prior Publication Data

US 2015/0268617 A1 Sep. 24, 2015

(30) Foreign Application Priority Data

Mar. 19, 2014 (JP) ..... 2014-055888

(51) Int. Cl.
*G03G 15/00* (2006.01)
*G03G 15/06* (2006.01)

(52) U.S. Cl.
CPC ..... *G03G 15/80* (2013.01); *G03G 15/065* (2013.01)

(58) Field of Classification Search
CPC ..... G03G 15/065; G03G 15/5004; G03G 15/0907; G03G 15/169; G03G 15/0266; G03G 15/80
USPC ..... 399/55
See application file for complete search history.

(56) References Cited

U.S. PATENT DOCUMENTS

2008/0226317 A1* 9/2008 Nakazawa ..... G03G 15/0216 399/50
2009/0244941 A1* 10/2009 Okada ..... G03G 15/065 363/63

FOREIGN PATENT DOCUMENTS

JP 61-166558 A 7/1986
JP 2011085710 A * 4/2011
JP 2012-252173 A 12/2012

* cited by examiner

*Primary Examiner* — Francis Gray
(74) *Attorney, Agent, or Firm* — Buchanan Ingersoll & Rooney PC

(57) ABSTRACT

An image forming apparatus having image supporting members and developing devices provided for a plurality of colors respectively, and a developing bias source. The developing bias source includes DC power circuits provided for the colors respectively, an AC power circuit provided for use in common for all of the colors, and an element provided for at least one of the colors other than black. The developing bias source generates developing biases by superimposing an AC voltage output from the AC power circuit on DC voltages output from the DC power circuits and applies the developing biases to the respectively corresponding developing devices. The element maintains a constant voltage having a potential of an opposite polarity to a potential of charged toner used for the development. The developing bias source further superimposes the constant voltage on the developing bias for the at least one of the colors other than black.

7 Claims, 8 Drawing Sheets

1A, 1B, 1C, 1D

IMAGE FORMING APPARATUS

This application claims benefit of priority to Japanese Patent Application No. 2014-055888 filed Mar. 19, 2014, the content of which is incorporated herein by reference.

BACKGROUND OF THE INVENTION

1. Field of the Invention

The present invention relates to an image forming apparatus, and more particularly to an image forming apparatus that develops a latent image on an image supporting member by applying a developing bias, which is a superimposed voltage of a DC voltage and an AC voltage, to a developing device.

2. Description of Related Art

As an image forming apparatus that develops a latent image on an image supporting member by applying a developing bias, which is a superimposed voltage of a DC voltage and an AC voltage, to a developing device, for example, an image forming apparatus disclosed in Japanese Patent Laid-Open Publication No. S61-166558 is known. Such an image forming apparatus (which will be hereinafter referred to as a conventional image forming apparatus) comprises image supporting members provided for a plurality of colors respectively, and developing devices provided for the plurality of colors respectively, and developing biases are applied to the respective developing devices for development of latent images formed on the image supporting members. The conventional image forming apparatus further comprises DC power circuits provided for the plurality of colors respectively to output DC components of the developing biases, and an AC power circuit for use in common to output AC components of the developing biases for all of the colors.

In the conventional image forming apparatus, however, the fact that the AC power circuit is used in common to output the AC components of the developing biases for all of the colors causes the following problem. Even in a monochromatic printing operation, toner movements from the developing devices for use in color printing to the corresponding image supporting members occur, which affects the picture quality of the developed image.

SUMMARY OF THE INVENTION

An object of the present invention is to provide an image forming apparatus that reduces or prevents toner movements from the developing devices for use in color printing to the corresponding image supporting members although having an AC power circuit for use in common to output AC components of developing biases for all of the colors.

An image forming apparatus according to an embodiment of the present invention comprises: a plurality of image supporting members provided for a plurality of colors including black, respectively; a plurality of developing devices provided for the plurality of colors respectively and configured to develop latent images formed on the image supporting members respectively with charged toner while being impressed with developing biases; a developing bias source including a plurality of DC power circuits provided for the plurality of colors respectively and configured to output DC voltages, an AC power circuit for use in common for all of the colors and configured to output an AC voltage, and an element provided for at least one of the colors other than black and configured to maintain a constant voltage independently from the outputs from the DC power circuits, the developing bias source configured to generate the developing biases by superimposing the AC voltage output from the AC power circuit on the DC voltages output from the respective DC power circuits and to apply the developing biases to the respectively corresponding developing devices; wherein: the constant voltage has a potential of an opposite polarity to a potential of the charged toner; and the developing bias source further superimposes the constant voltage output from the element on at least one of the developing biases for the at least one of the colors other than black.

DETAILED DESCRIPTION OF THE PREFERRED EMBODIMENTS

Figure 1:
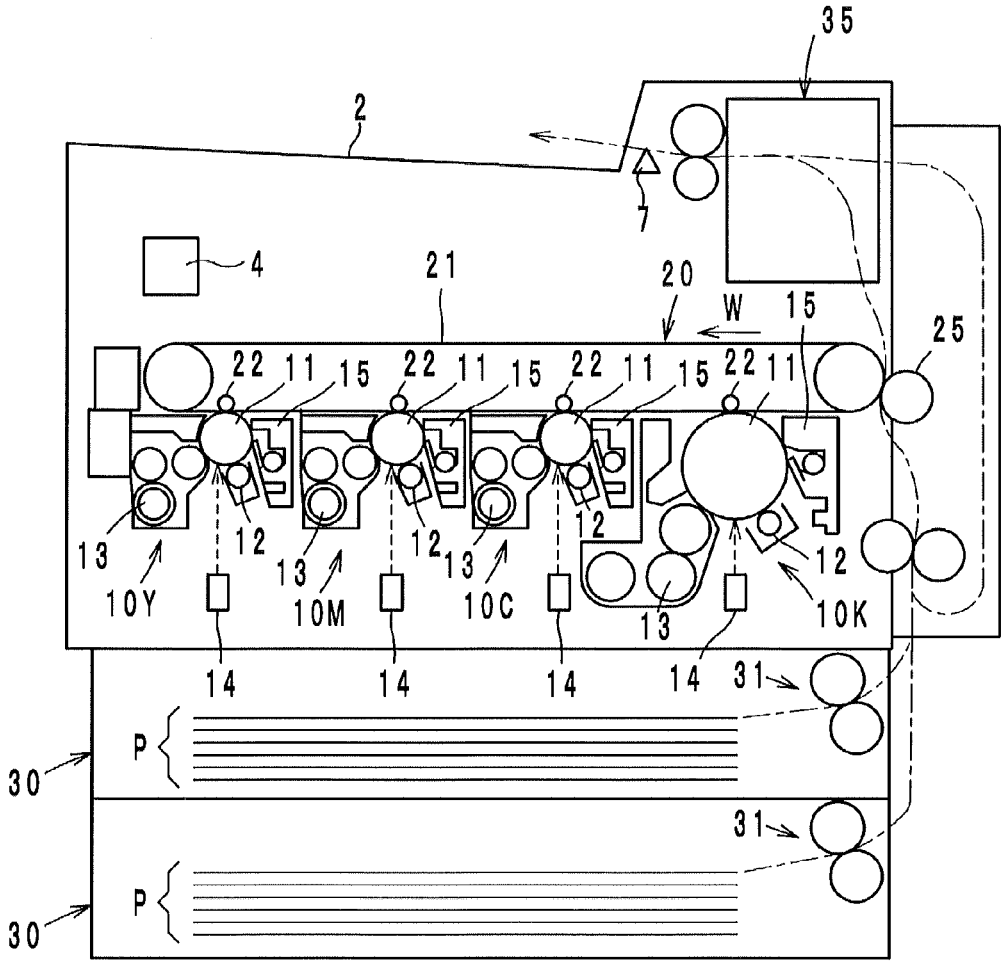
FIG. 1 is a schematic view illustrating the internal structure of an image forming apparatus.

General Structure of Image Forming Apparatus; See FIG. 1

An image forming apparatus 1A according to a first embodiment is described below with reference to the drawings. In the drawings, the same members and parts are provided with the same reference marks, and the same descriptions will be omitted.

As illustrated in FIG. 1, the image forming apparatus 1A according to the first embodiment is a tandem-type electrophotographic printer. The image forming apparatus 1A comprises a control unit 4 configured to control the components and members of the image forming apparatus 1A, imaging units 10 (10Y, 10M, 10C and 10K) configured to form toner images in colors of Y (yellow), M (magenta), C (cyan) and K (black) respectively, and an intermediate transfer unit 20.

In each of the imaging units 10, a charger 12, a developing device 13 and other devices are arranged around a photoreceptor drum 11. The photoreceptor drum 11 is exposed to light emitted from a laser scanning optical unit 14, so that an electrostatic latent image is formed on the photoreceptor drum 11, and negatively charged toner is moved from the developing device 13 to the photoreceptor drum 11 so as to develop the electrostatic latent image. In this way, toner images in the respective colors are formed. The intermediate transfer unit 20 includes an intermediate transfer belt 21 driven to rotate endlessly in a direction indicated by arrow W. By electric field applications from first transfer rollers 22 respectively opposed to the photoreceptor drums 11, the toner images formed on the photoreceptor drums 11 are transferred onto the intermediate transfer belt 21 and combined thereon (first transfer), thereby forming into a composite toner image. Such an electrophotographic process is well known, and details are omitted.

In the lower section of the image forming apparatus body, an automatic sheet feeder unit 30 configured to feed sheets of a transfer substance (which will be referred to as sheets) one by one is provided. Each sheet is fed from a feed roller (not indicated in the drawings) to a nip portion between the intermediate transfer belt 21 and a second transfer roller 25 via a pair of timing rollers 31, and by an electric field application from second transfer roller 25, the toner image (composite color image) is transferred from the intermediate transfer belt 21 to the sheet. Thereafter, the sheet is fed to a fixing unit 35, where toner is fixed on the sheet by heat, and then, the sheet is ejected to a tray section 2 on the upper surface of the apparatus body.

Structure of Developing Bias Source; See FIGS. 2-4

Figure 2:
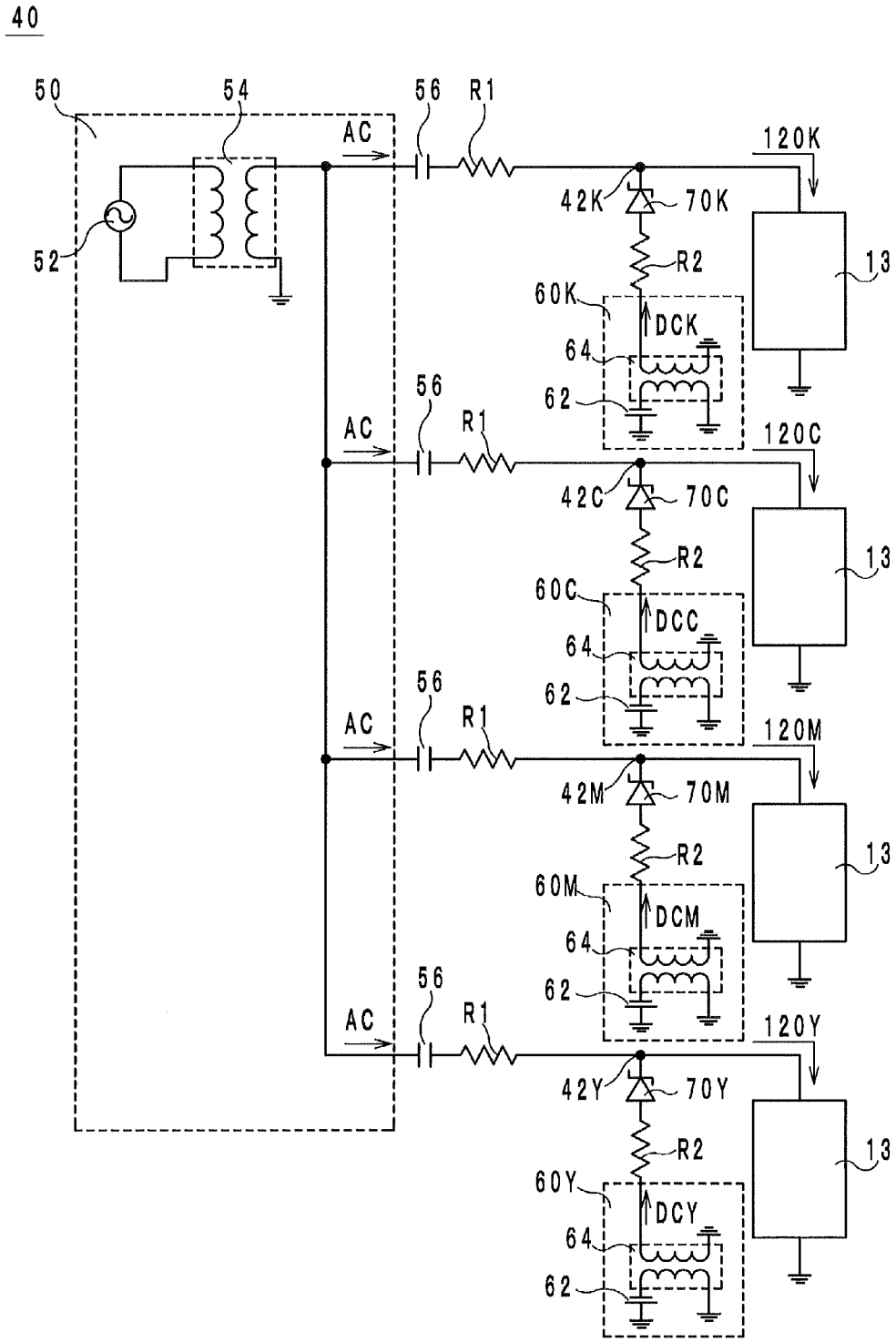
FIG. 2 is a diagram illustrating an electric circuit of a developing bias source provided for an image forming apparatus according to a first embodiment and illustrating relation between the developing bias source and developing devices.

The image forming apparatus further comprises a developing bias source 40 as illustrated in FIG. 2.

The developing bias source 40 includes an AC power circuit 50 for use in common for the colors Y, M, C and K, DC power circuits 60 (60Y, 60M, 60C and 60K) provided for the colors Y, M, C and K respectively, four capacitors 56 provided for the colors Y, M, C and K respectively, resistors R1 and R2 provided for each of the colors Y, M, C and K, and zener diodes 70 (70Y, 70M, 70C and 70K) having a zener voltage of 200V and provided for the colors Y, M, C and K respectively.

Figure 3:
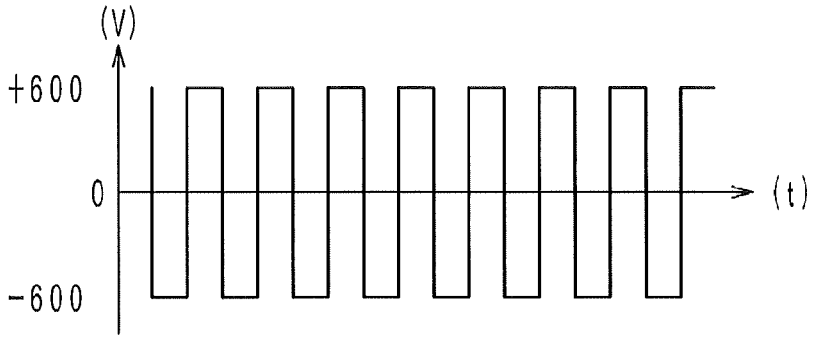
FIG. 3 is a diagram of an output voltage that is output from an AC power circuit of the developing bias source during a color printing operation.

In this embodiment, the AC power circuit 50 includes an AC power source 52 and an AC transformer 54, and outputs an AC voltage AC (which will be hereinafter referred to as an AC output voltage) under control of the control unit 4. Specifically, the AC power source 52 is connected to a primary side of the AC transformer 54. The AC voltage from the AC power source 52 is raised by the AC transformer 54, and is output as the AC output voltage AC of 1200 Vp-p as illustrated in FIG. 3.

In this embodiment, a secondary side of the AC transformer 54, that is, the output port of the AC transformer 54 diverges into four, and the four ports are connected to respective one ends of the four capacitors 56 for the respective colors. Thereby, the AC output voltage AC is fed to the developing devices 13 via the capacitors 56. Respective one ends of the resistors R1 are connected to the other ends of the capacitors 56 so as to control the current flow to the developing devices 13.

Figure 4:
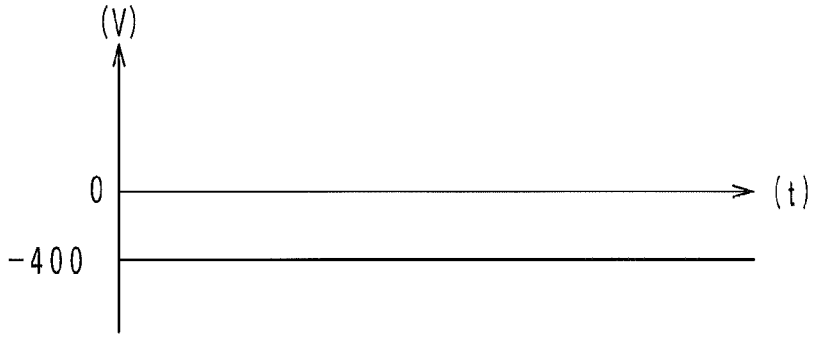
FIG. 4 is a diagram of an output voltage that is output from a DC power circuit of the developing bias source during a color printing operation.

In this embodiment, each of the DC power circuits 60Y, 60M, 60C and 60K includes a DC power source 62 and a DC transformer 64. Under control of the control unit 4, DC voltages DCY, DCM, DCC and DCK of −400V (which will be hereinafter referred to as DC output voltages) as illustrated in FIG. 4 are output from the DC power circuits 60Y, 60M, 60C and 60K respectively. In this regard, for the reasons that the toner characteristic varies from color to color and others, the potentials of the DC output voltages DC for the respective colors shall be individually adjusted by stabilization control. Therefore, the DC power circuits 60 are provided individually for the respective colors. Respective one ends of the resistors R2 are connected to the output ports of the DC power circuits 60 so as to control the current flows to the developing devices 13.

The anode terminals of the zener diodes 70Y, 70M, 70C and 70K are connected to the other ends of the resistors R2. In other words, the zener diodes 70Y, 70M, 70C and 70K are connected such that the directions from the respective DC circuits 60Y, 60M, 60C and 60K to the corresponding developing devices 13 are forward directions of the zener diodes 70Y, 70M, 70C and 70K.

The cathode terminals of the zener diodes 70Y, 70M, 70C and 70K are connected to nodes 42Y, 42M, 42C and 42K which the AC output voltages fed toward the developing devices 13 pass through respectively. At the nodes 42Y, 42M, 42C and 42K, the AC output voltage is superimposed on the DC output voltages DCY, DCM, DCC and DCK, and in this way, the developing biases 120Y, 120M, 120C and 120K for the respective colors are generated.

Details of Developing Biases; See FIGS. 2, 3, 5-7

Figure 5:
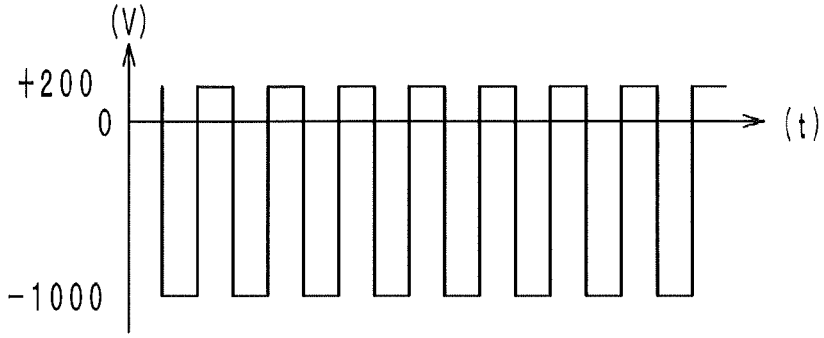
FIG. 5 is a diagram of an output voltage that is output from the developing bias source during a color printing operation, the output voltage being a superimposed voltage of the output voltage from the DC power circuit on the output voltage from the AC power circuit.
Figure 6:
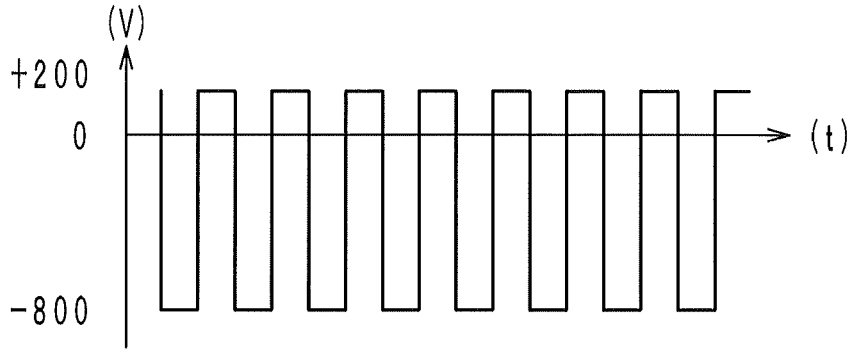
FIG. 6 is a diagram of a potential during a color printing operation at a node of the AC power circuit and the DC power circuit in an electric circuit of the developing bias source.

For color printing, the DC power circuits 60Y, 60M, 60C and 60K output DC output voltages DCY, DCM, DCC and DCK of −400V. Simple superimposition of the AC output voltage AC of 1200 Vp-p on the DC output voltages DCY, DCM, DCC and DCK will result in AC output voltages AC having a maximum voltage of 200V and a minimum voltage of −1000V as illustrated in FIG. 5. In this embodiment, however, the zener diodes 70Y, 70M, 70C and 70K are provided between the respective output ports of the DC power circuits 60Y, 60M, 60C and 60K and the respective nodes 42Y, 42M, 42C and 42K. With this arrangement, the developing biases 120Y, 120M, 120C and 120K become AC voltages having a maximum voltage of 200V and a minimum voltage of −800V as illustrated in FIG. 6.

Figure 7:
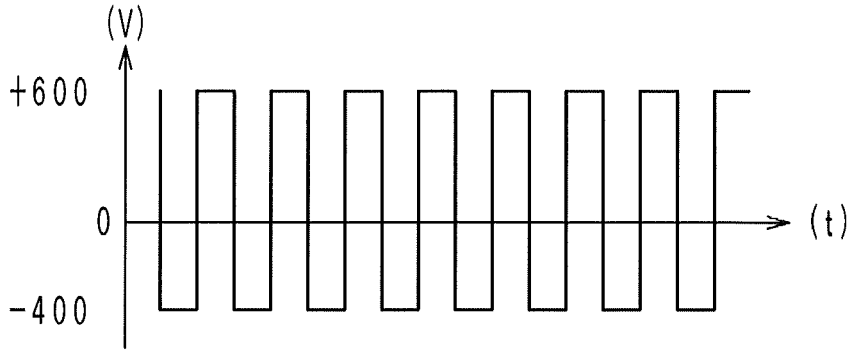
FIG. 7 is a diagram of a potential during a monochromatic printing operation at a node of the AC power circuit and the DC power circuit in the electric circuit of the developing bias source.

For monochromatic printing, on the other hand, it is not necessary to move toner from the developing devices 13 for the colors Y, M and C to the corresponding photoreceptor drums 11, and the DC power sources 62 for the colors Y, M and C are turned off. Accordingly, the DC output voltages DCY, DCM and DCC are 0V. Meanwhile, since the AC power circuit 50 is used in common for the colors Y, M, C and K, an AC voltage of 1200 Vp-p as illustrated in FIG. 3 is output from the AC power circuit 50 as the AC output voltage AC. In this embodiment, the zener diodes 70Y, 70M, 70C and 70K are provided between the respective output ports of the DC power circuits 60Y, 60M, 60C and 60K and the respective nodes 42Y, 42M, 42C and 42K. With the arrangement, AC voltages having a maximum voltage of 600V and a minimum voltage of −400V as illustrated in FIG. 7 result as the developing biases 120Y, 120M and 120C for the colors Y, M and C. Thus, because of the presence of the zener diodes 70, the developing biases shift to the positive side, that is, in a direction opposite to the polarity (negative) of the toner.

Output Control of Developing Biases; See FIGS. 6-9

Figure 8:
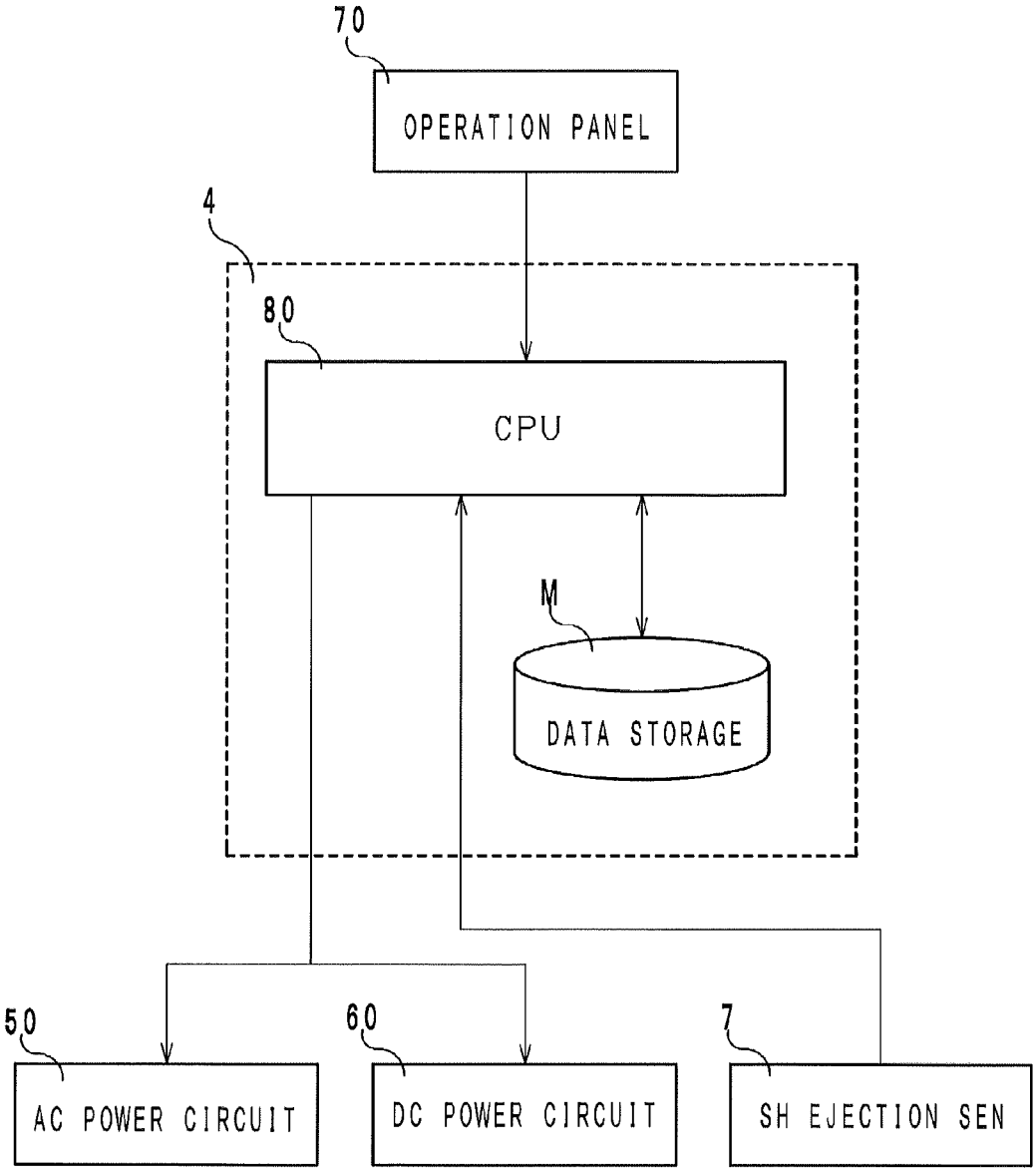
FIG. 8 is a block diagram illustrating relation among a control unit, the AC power circuit, the DC power circuit and a sheet ejection sensor.

The image forming apparatus 1A further comprises an operation panel 70 as indicated in FIG. 8. The control unit 4 includes a CPU 80 and a data storage section M. In the image forming apparatus 1A, as illustrated in FIG. 8, the operation panel 70 receives an input from a user, and the data are sent to the CPU 80 in the control unit 4 that controls the components and the members of the image forming apparatus 1A. On receiving the data, the CPU 80 controls the developing biases while referring to various values stored in the data storage section M of the control unit 4. Details of the developing bias control carried out by the control unit 4 are described below.

The control is started by an input from a user. The input from a user is, for example, an input to request for a display of a print mode selection from several modes, such as a color print mode, a monochromatic print mode, etc.

Figure 9:
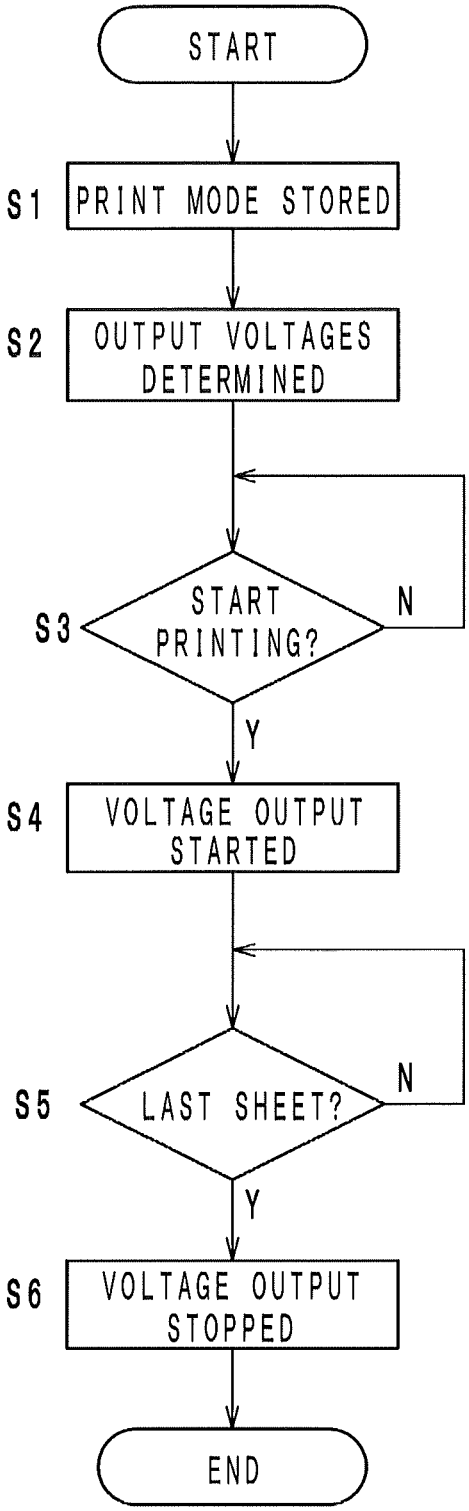
FIG. 9 is a flowchart illustrating a control process of outputs from the power circuits of the developing bias source.

As indicated in FIG. 9, at step S1, the control unit 4 stores a result of the print mode selection done by the user.

At step S2, the control unit 4 determines the output voltage from the AC power source 52 and the output voltages from the DC power sources 62 based on the data stored at step S1. Specifically, in a case where the color print mode is selected as the print mode, the output voltage from the AC power source 52 is determined such that the AC output voltage output from the AC power circuit 50 will be 1200 Vp-p, and the output voltages from the DC power sources 62 are determined such that the DC output voltages output from the DC power circuits 60 will be −400V. In a case where the monochromatic print mode is selected as the print mode, the output voltage from the AC power source 52 is determined such that the AC output voltage output from the AC power circuit 50 will be 1200 Vp-p, and the output voltages from the DC power sources 62 for the colors Y, M and C are determined as 0V.

At step S3, the control unit 4 determines whether a print request has been input from a user, that is, whether to start a print job. If a print job is to be started, the process goes to step S4, and if there is no print request input, the process stands by at step S3.

At step S4, the control unit 4 makes the AC power source and the DC power sources 62 start outputting voltages. Accordingly, in a case of color printing, the developing devices 13 are impressed with the developing biases as illustrated in FIG. 6, and in a case of monochromatic printing, the developing devices 13 for the colors Y, M and C are impressed with the developing biases as illustrated in FIG. 7.

At step S5, the control unit 4 determines whether the last sheet in the current print job has been ejected to the tray 2. When it is determined that the last sheet has been ejected, the process goes to step S6. The process stays at step 5 until it is determined that the last sheet has been ejected. The determination of whether the last sheet has been ejected is based on a signal sent from a sheet ejection sensor 7.

At step S6, the control section 4 makes the AC power source 52 and the DC power sources 62 stop outputting the voltages. With that, the process comes to the end.

Advantageous Effects

In the image forming apparatus 1A, the developing bias source 40 further superimposes voltages from the zener diodes 70Y, 70M, 70C and 70K on the developing biases 120Y, 120M, 120C and 120K and applies the superimposed voltages to the developing devices 13. With this arrangement, the developing biases 120Y, 120M, 120C and 120K shift to the positive side, that is, in a direction opposite to the polarity of the negatively-charged toner. Moreover, the offset does not depend on the outputs from the DC power circuits 60Y, 60M, 60C and 60K. Accordingly, in a case of monochromatic printing, that is, when the outputs from the DC power circuits 60Y, 60M and 60C, which are for the colors only used for color printing, are 0V, the developing biases for the colors used for color printing have a positive polarity that is opposite to the polarity of the negatively-charged toner. Accordingly, at a time of monochromatic printing, the developing devices 13C, 13Y and 13M for the colors used for color printing have a positive polarity that is opposite to the polarity of the toner. At a time of monochromatic printing, the surfaces of the photoreceptor drums 11 for use in color printing have a potential of 0V. Therefore, during monochromatic printing, the negatively-charged toner is attracted by the developing devices 13C, 13Y and 13M that are charged positive in relation to the surface potential of the photoreceptor drums 11. Hence, during monochromatic printing, the image forming apparatus 1A reduces or prevents toner movements from the developing devices 13C, 13Y and 13M to the photoreceptor drums 11 for use in color printing.

Since toner movements from the developing devices 13 to the photoreceptor drums 11 for use in color printing are prevented during monochromatic printing, situations that may degrade the picture quality, for example, white stripes on the photoreceptor drums, toner adhesion to the photoreceptor drums, etc. are avoided, and waste of toner is reduced.

Second Embodiment; See FIG. 10

Figure 10:
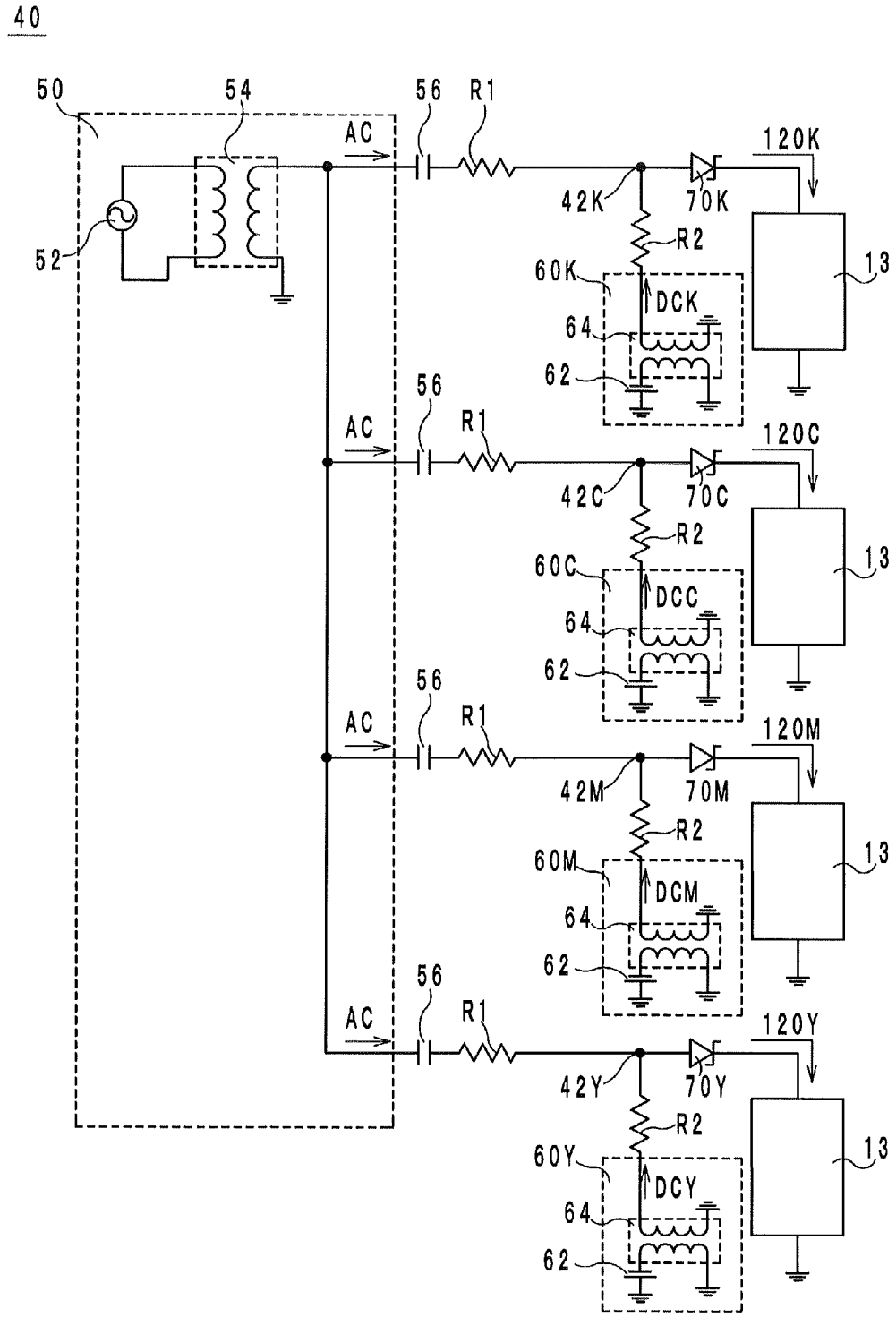
FIG. 10 is a diagram illustrating an electric circuit of a developing bias source provided for an image forming apparatus according to a second embodiment and illustrating relation between the developing bias source and developing devices.

An image forming apparatus 1B according to a second embodiment is different from the image forming apparatus 1A according to the first embodiment in the positions of the zener diodes 70Y, 70M, 70C and 70K in the electric circuit of the developing bias source 40. Specifically, in the image forming apparatus 1B, as illustrated in FIG. 10, the zener diodes 70Y, 70M, 70C and 70K are disposed between the respective nodes 42Y, 42M, 42C and 42K and the respective output ports of the developing bias source 40. The structures of the other parts of the image forming apparatus 1B and the function effects of the image forming apparatus 1B are similar to those of the image forming apparatus 1A according to the first embodiment.

Third Embodiment; See FIG. 11

Figure 11:
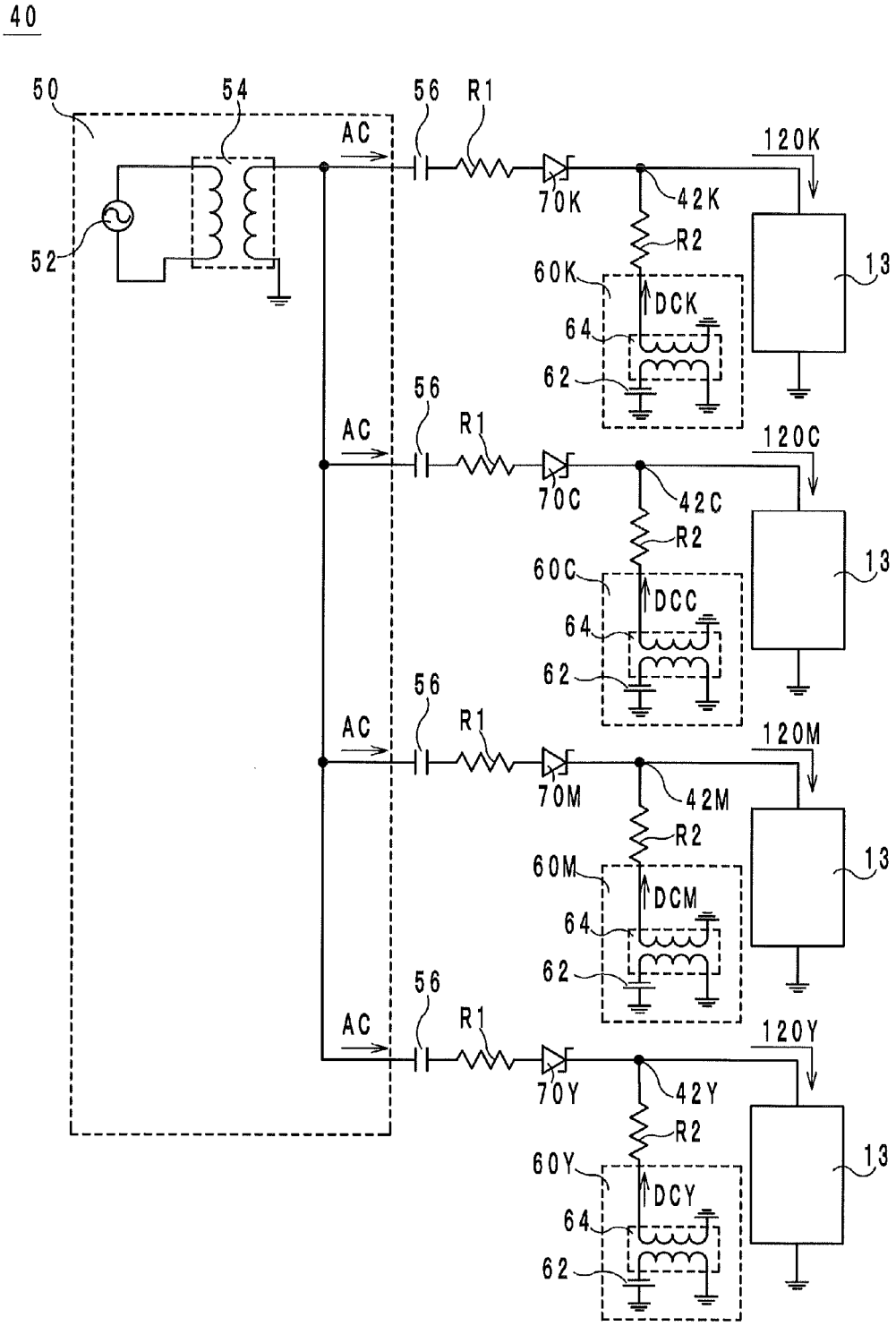
FIG. 11 is a diagram illustrating an electric circuit of a developing bias source provided for an image forming apparatus according to a third embodiment and illustrating relation between the developing bias source and developing devices.

An image forming apparatus 1C according to a third embodiment is different from the image forming apparatus 1A according to the first embodiment in the positions of the zener diodes 70Y, 70M, 70C and 70K in the electric circuit of the developing bias source 40. Specifically, in the image forming apparatus 1C, as illustrated in FIG. 11, the zener diodes 70Y, 70M, 70C and 70K are disposed between the respective nodes 42Y, 42M, 42C and 42K and the respective capacitors 56. The structures of the other parts of the image forming apparatus 1C and the function effects of the image forming apparatus 1C are similar to those of the image forming apparatus 1A according to the first embodiment.

Fourth Embodiment

An image forming apparatus 1D according to a fourth embodiment is different from the image forming apparatus 1A according to the first embodiment in that the zenor diode 70K is not provided in a developing bias source 50 of the image forming apparatus 1D. The structures of the other parts of the image forming apparatus 1D and the function effects of the image forming apparatus 1D are similar to those of the image forming apparatus 1A according to the first embodiment.

Other Embodiments

The specific potentials of the voltages and the condition for a start of the developing bias control can be designed arbitrarily.

Although the present invention has been described in connection with the preferred embodiments above, it is to be noted that various changes and modifications are obvious to those who are skilled in the art. Such changes and modifications are to be understood as being within the scope of the invention.

What is claimed is:

1. An image forming apparatus comprising:

a plurality of image supporting members provided for a plurality of colors including black, respectively;

a plurality of developing devices provided for the plurality of colors respectively and configured to develop latent images formed on the image supporting members respectively with charged toner while being impressed with developing biases;

a developing bias source including a plurality of DC power circuits provided for the plurality of colors respectively and configured to output DC voltages, an AC power circuit for use in common for all of the colors and configured to output an AC voltage, and an element provided for at least one of the colors other than black and configured to maintain a constant voltage independently from the outputs from the DC power circuits, the developing bias source configured to generate the developing biases by superimposing the AC voltage output from the AC power circuit on the DC voltages output from the respective DC power circuits and to apply the developing biases to the respectively corresponding developing devices; wherein:

the constant voltage has a potential of an opposite polarity to a potential of the charged toner; and the developing bias source further superimposes the constant voltage output from the element on at least one of the developing biases for the at least one of the colors other than black.

2. The image forming apparatus according to claim 1, wherein:

the element is a zener diode; and the element is located in an electric circuit such that a direction from at least one of the DC power circuits provided for the at least one of the colors other than black to at least one of the developing devices provided for the at least one of the colors other than black or alternatively a direction from the AC power circuit to the at least one of the developing devices provided for the at least one of the colors other than black is a forward direction of the zener diode.

3. The image forming apparatus according to claim 2, wherein the element is located in the electric circuit, between the at least one of the DC power circuits provided for the at least one of the colors other than black and a node of the at least one of the DC power circuits and the AC power circuit.

4. The image forming apparatus according to claim 2, wherein the element is located in the electric circuit, between a node of the at least one of the DC power circuits provided for the at least one of the colors other than black and the AC power circuit and the at least one of the developing devices provided for the at least one of the colors other than black.

5. The image forming apparatus according to claim 2, wherein the element is located in the electric circuit, between the AC power circuit and a node of the at least one of the DC power circuits provided for the at least one of the colors other than black and the AC power circuit.

6. The image forming apparatus according to claim 1, wherein the element is not connected to one of the DC developing devices provided for black.

7. The image forming apparatus according to claim 1, wherein the plurality of DC power circuits are controlled individually.

* * * * *